US010029898B2

(12) United States Patent
Sollers et al.

(10) Patent No.: US 10,029,898 B2
(45) Date of Patent: Jul. 24, 2018

(54) MAXIMIZING SCISSOR LIFT BREAKOVER ANGLE WITH FIXED POTHOLE PROTECTION

(71) Applicant: JLG Industries, Inc., Hagerstown, MD (US)

(72) Inventors: Jesse Sollers, Fayetteville, PA (US); Devin Rosencrance, Chambersburg, PA (US); Troy Young, Mercersburg, PA (US)

(73) Assignee: JLG INDUSTRIES, INC., Hagerstown, MD (US)

( * ) Notice: Subject to any disclaimer, the term of this patent is extended or adjusted under 35 U.S.C. 154(b) by 0 days.

(21) Appl. No.: 14/125,374

(22) PCT Filed: Oct. 17, 2012

(86) PCT No.: PCT/US2012/060506
§ 371 (c)(1),
(2) Date: Dec. 11, 2013

(87) PCT Pub. No.: WO2013/059243
PCT Pub. Date: Apr. 25, 2013

(65) Prior Publication Data

US 2014/0110190 A1 Apr. 24, 2014

Related U.S. Application Data

(60) Provisional application No. 61/547,936, filed on Oct. 17, 2011.

(51) Int. Cl.
*B66F 17/00* (2006.01)
*E04G 1/22* (2006.01)
(Continued)

(52) U.S. Cl.
CPC ..... *B66F 17/006* (2013.01); *B66F 11/042* (2013.01); *E04G 1/22* (2013.01); *E04G 1/24* (2013.01)

(58) Field of Classification Search
CPC .... E04G 5/00; E04G 1/22; E04G 1/24; E04G 2001/242; E04G 2001/244; B66F 11/042; B66F 17/006
(Continued)

(56) References Cited

U.S. PATENT DOCUMENTS 596,676 A * 1/1898 Ford ..... 182/51
3,749,201 A 7/1973 Clarke
(Continued)

FOREIGN PATENT DOCUMENTS

JP 2000-281295 10/2000
JP 2009-143676 7/2009

OTHER PUBLICATIONS

International Search Report dated Jan. 22, 2013 issued in PCT International Patent Application No. PCT/US2012/060506, 1 page.
(Continued)

*Primary Examiner* — Katherine W Mitchell
*Assistant Examiner* — Shiref M Mekhaeil
(74) *Attorney, Agent, or Firm* — Nixon & Vanderhye P.C.

(57) ABSTRACT

A pothole protection assembly is cooperable with a support base of a scissor lift. The support base includes front wheels, rear wheels and a chassis. The pothole protection assembly includes a pair of front pothole bars fixed to the chassis and each positioned adjacent the front wheels, respectively, and a pair of rear pothole bars fixed to the chassis and each positioned adjacent the rear wheels, respectively. A space between the front wheels and the rear wheels defines a ground clearance zone, where the front pothole bars and the rear pothole bars are disposed at opposing ends of the
(Continued)

ground clearance zone. The assembly is constructed and arranged to maximize a breakover angle in a scissor lift with fixed pothole protection.

8 Claims, 5 Drawing Sheets

(51) Int. Cl.
*E04G 1/24* (2006.01)
*B66F 11/04* (2006.01)

(58) Field of Classification Search
USPC ..... 182/18, 19, 2.1–2.11, 63.1, 64.1, 65.1, 182/66.1, 66.2, 67.1–67.5, 68.1–68.3, 182/69.1–69.6; 280/755
See application file for complete search history.

(56) References Cited

U.S. PATENT DOCUMENTS 3,850,111 A * 11/1974 Hansen ..... 104/245
4,401,408 A * 8/1983 Gibert ..... 414/687
4,456,093 A * 6/1984 Finley et al. ..... 182/2.2
4,531,882 A * 7/1985 Pierre ..... 414/687
5,740,887 A 4/1998 Unger et al.
5,875,869 A * 3/1999 Busuttil et al. ..... 182/69.6
5,890,737 A * 4/1999 Hutka ..... 280/755
6,019,190 A * 2/2000 Luebrecht et al. ..... 182/18
6,772,850 B1 * 8/2004 Waters et al. ..... 180/65.51
7,828,116 B2 * 11/2010 Vetesnik ..... 182/18
2009/0174176 A1 * 7/2009 Cui ..... 280/755
2010/0193290 A1 * 8/2010 Cui ..... 182/69.5

OTHER PUBLICATIONS

Japanese Office Action dated Jan. 20, 2015 issued in Japanese Patent Application No. 2014-520415 and English Translation, 7 pp.
"Easy Up 5 Easy Up 5 SP," Euroliftsystem, Sep. 20, 2011, XP055178002, Retrieved from the Internet: URL:http://www.euroliftsystem.com/WebGUI2/www/uploads/563/EasyUp5-5SP.pdf [retrieved on Mar. 19, 2015], 4 pp.
Extended European Search Report dated Mar. 20, 2015 issued in European Patent Application No. 12841051.1, 9 pp.
"Iteco Self-Propelled Push Around," Vertikal.net, Aug. 12, 2011, XP055178066, Retrieved from the Internet: URL:http://www.vertikal.net/en/news/story/12958/ [retrieved on Mar. 20, 2015], 4 pp.
"Mast Boom Lifts JLG Model Toucan 10E", Jan. 1, 2008, XP055178065, Retrieved from the Internet: URL:http://www.rentalift.be/docs/JLGToucan10E.pdf [retrieved on Mar. 20, 2015], 2pp.
"So war die APEX," Vertikal.net, Sep. 19, 2011, XP055178011, Retrieved from the Internet: URL:http://www.vertikal.net/de/news/artikel/13188/ [retrieved on Mar. 19, 2015], 26 pp.

* cited by examiner

MAXIMIZING SCISSOR LIFT BREAKOVER ANGLE WITH FIXED POTHOLE PROTECTION

This application is the U.S. national phase of International Application No. PCT/US2012/060506 filed 17 Oct. 2012 which designated the U.S. and claims priority to U.S. Provisional Patent Application No. 61/547,936 filed 17 Oct. 2011, the entire contents of each of which are hereby incorporated by reference.

BACKGROUND OF THE INVENTION

The invention relates to a pothole protection mechanism for a vehicle including an aerial work platform (AWP) and, more particularly, to maximizing a breakover angle in a scissor lift with fixed pothole protection.

Self-propelled AWPs such as scissor lifts are typically equipped with an apparatus that prevents them from tipping when driven into a pothole or off a curb while the platform is elevated. Such an apparatus works normally by reducing the ground clearance to less than one inch when the platform of the AWP is elevated beyond a certain height.

One way of achieving this is by means of a bar or a plate that is attached to the chassis of the AWP and can be lowered down and locked in position when the platform is elevated. Subsequently, the bar or plate can be raised up when the platform is lowered.

The mechanism that performs the lowering, locking and raising tasks is referred to as a pothole protection mechanism.

With the pothole protection mechanism extended, a breakover angle—i.e., a ground angle over which the protection bar will engage the ground—is reduced. For such systems to retract or extend, existing pothole protection mechanisms include sensors, cams, springs, pins, bearings, etc. to allow the pothole system to properly function to avoid having an unacceptable breakover angle or to avoid capsizing a machine.

SUMMARY OF THE INVENTION

It would be desirable to provide a fixed pothole protection device that provides the same protection and breakover angle as existing active pothole systems but without the need for complex moving parts. The fixed pothole protection assembly of preferred embodiments achieves what the active system can in both stability and breakover angle without moving parts or sensors. In one configuration, this is achieved by utilizing strategically placed structural members near the machine wheels to catch the edges of the pothole and keep the machine stable with the platform elevated. Keeping the components near the wheels, instead of all the way across the machine belly, provides for an acceptable ground clearance.

In an exemplary embodiment, a pothole protection assembly is cooperable with a support base of a scissor lift. The support base includes front wheels, rear wheels and a chassis. The pothole protection assembly includes a pair of front pothole bars fixed to the chassis and each positioned adjacent the front wheels, respectively, and a pair of rear pothole bars fixed to the chassis and each positioned adjacent the rear wheels, respectively. A space between the front wheels and the rear wheels defines a ground clearance zone, and the front pothole bars and the rear pothole bars are disposed at opposing ends of the ground clearance zone.

The front pothole bars may be positioned relative to the front wheels in a manner such that a vertical line tangent to the front wheels intersects a portion of the front pothole bars. Similarly, the rear pothole bars may be positioned relative to the rear wheels in a manner such that a vertical line tangent to the rear wheels intersects a portion of the rear pothole bars. In this context, ends of the front and rear pothole bars may be tapered. Moreover, the front and rear pothole bars may be substantially parallelogram shaped. Still further, a bottom surface of the front pothole bars may be skewed forward of a top surface of the front pothole bars, and a bottom surface of the rear pothole bars may be skewed rearward of a top surface of the rear pothole bars.

In one arrangement, the front pothole bars and the rear pothole bars are positioned to maximize a ground clearance of the support base.

The pothole protection assembly may additionally include a front inner frame plate adjacent an inside surface of each of the front wheels and a rear inner frame plate adjacent an inside surface of each of the rear wheels. The front inner frame plates and the rear inner frame plates may be positioned within a profile of the front wheels and the rear wheels, respectively In another exemplary embodiment, a scissor lift includes a support base with front wheels, rear wheels and a chassis, and the pothole protection assembly of the described embodiments. A tilt sensor cooperable with the support base may detect a tilt amount of the scissor lift. The scissor lift may additional include a drive system that effects wheel drive and platform lift. In this context, the tilt sensor may communicate with the drive system such that if the tilt sensor detects that the tilt amount of the scissor lift exceeds a predefined amount, the drive system deactivates the wheel drive and the platform lift.

In yet another exemplary embodiment, a pothole protection assembly is cooperable with a support base of a scissor lift. The pothole protection assembly includes a front assembly with a pair of front pothole bars fixed to the chassis and a rear assembly with a pair of rear pothole bars fixed to the chassis. The pothole bars are each positioned adjacent the front/rear wheels of the support base, respectively. The bars are sized such that if one of the wheels falls into a pothole, the respective pothole bar adjacent the one of the wheels will prevent the support base from tilting beyond a predefined amount.

BRIEF DESCRIPTION OF THE DRAWINGS

These and other aspects and advantages will be described in detail with reference to the accompanying drawings, in which.

DETAILED DESCRIPTION OF THE DRAWINGS

Figure 1:
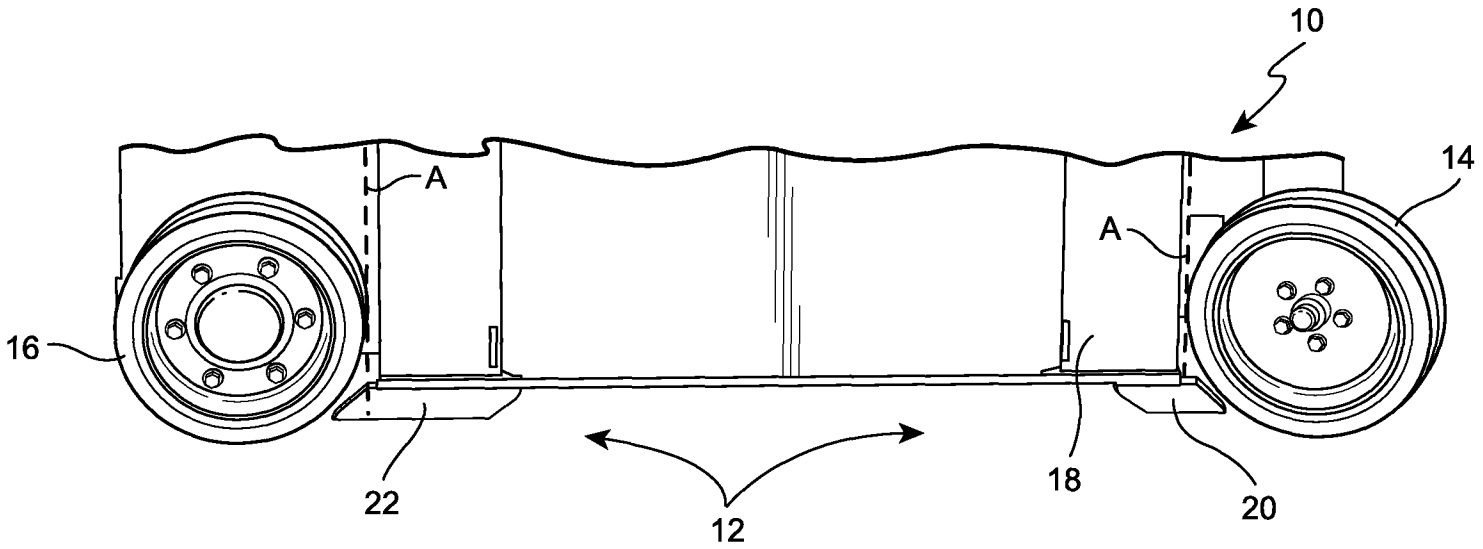
FIG. 1 is a side view of an exemplary scissor lift including the fixed pothole protection assembly according to preferred embodiments.
Figure 2:
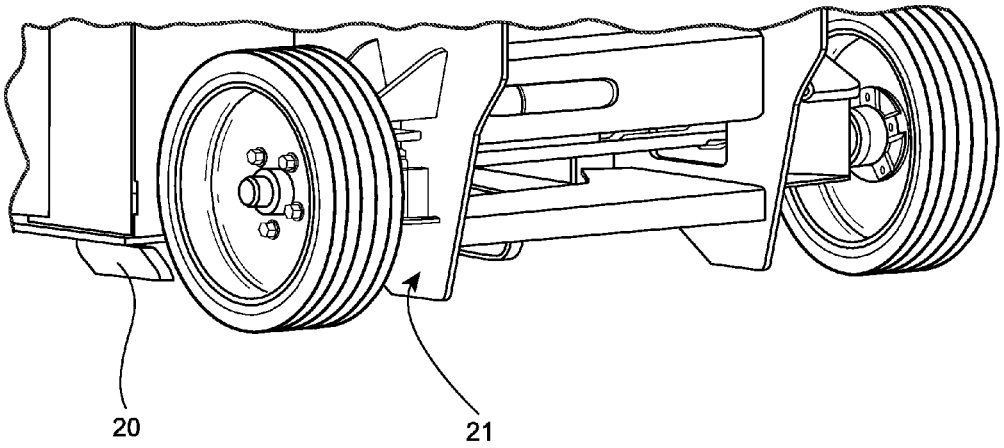
FIGS. 2 and 3 are perspective views of the pothole protection assembly.
Figure 3:
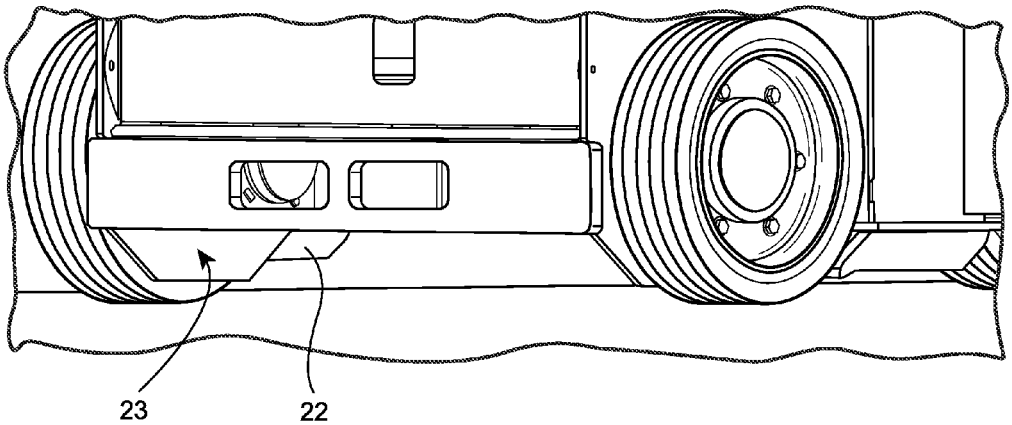

FIG. 1 is a side view of scissor lift support base 10 including a pothole protection assembly 12, and FIGS. 2 and 3 are perspective views. The support base 10 includes front wheels 14, rear wheels 16, and a chassis 18. The pothole protection assembly 12 includes a front assembly with a pair of front pothole bars 20 fixed such as by welding or the like to the chassis 18 and positioned adjacent the front wheels 14 as shown. The front assembly also includes a front inner frame plate 21 adjacent each front wheel 14. A rear assembly includes a pair of rear pothole bars 22 that are also fixed to the chassis 18 and are positioned adjacent the rear wheels 16. Rear inner frame plates 23 are positioned adjacent each wheel. A space between the front wheels 14 and the rear wheels 16 defines a ground clearance zone 24. As shown, the front pothole bars 20 and the rear pothole bars 22 are disposed at opposing ends of the ground clearance zone 24. See FIGS. 4 and 5.

With continued reference to FIG. 1, the front pothole bars 20 are positioned relative to the front wheels 14 in a manner such that a vertical line A tangent to the front wheels intersects a portion of the front pothole bars 20. The rear pothole bars 22 are similarly configured.

In a preferred construction, ends of the front and rear pothole bars 20, 22 are tapered, where the front and rear pothole bars 20, 22 are preferably substantially parallelogram shaped. With the parallelogram shape, a bottom surface of the front pothole bars 20 is skewed forward of a top surface of the front pothole bars 20, and a bottom surface of the rear pothole bars 22 is skewed rearward of a top surface of the rear pothole bars 22. Regardless of the preferred construction, it is desirable to position the front pothole bars 20 and the rear pothole bars 22 in a manner that serves to maximize a ground clearance of the support base 10. See FIG. 5.

The scissor lift vehicle may additionally include a tilt sensor 26 cooperable with the support base 10 that detects a tilt amount of the vehicle. A drive system 28 that effects wheel drive and platform lift receives signals from the tilt sensor 26. If the tilt sensor 26 detects that the tilt amount of the vehicle exceeds a predefined amount, the drive system 28 deactivates the wheel drive and the platform lift.

Figure 4:
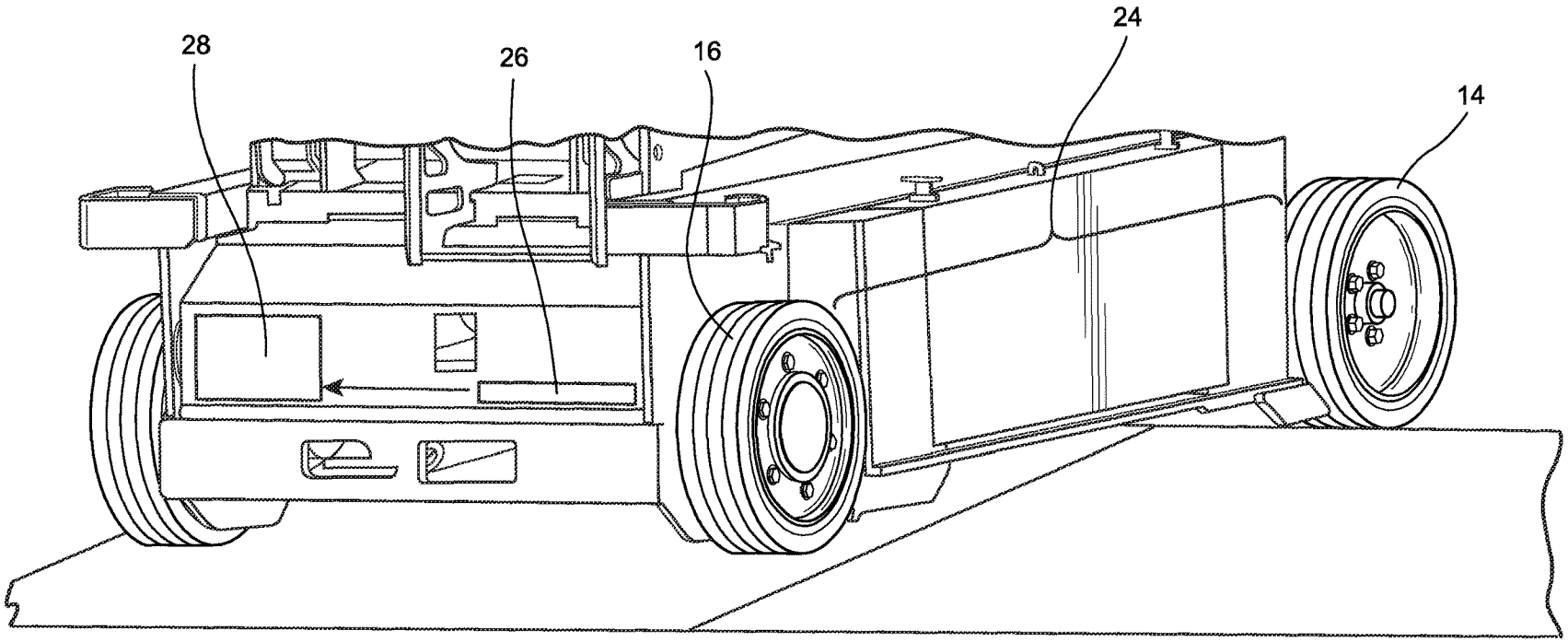
FIG. 4 is a perspective view of the scissor lift.
Figure 5:
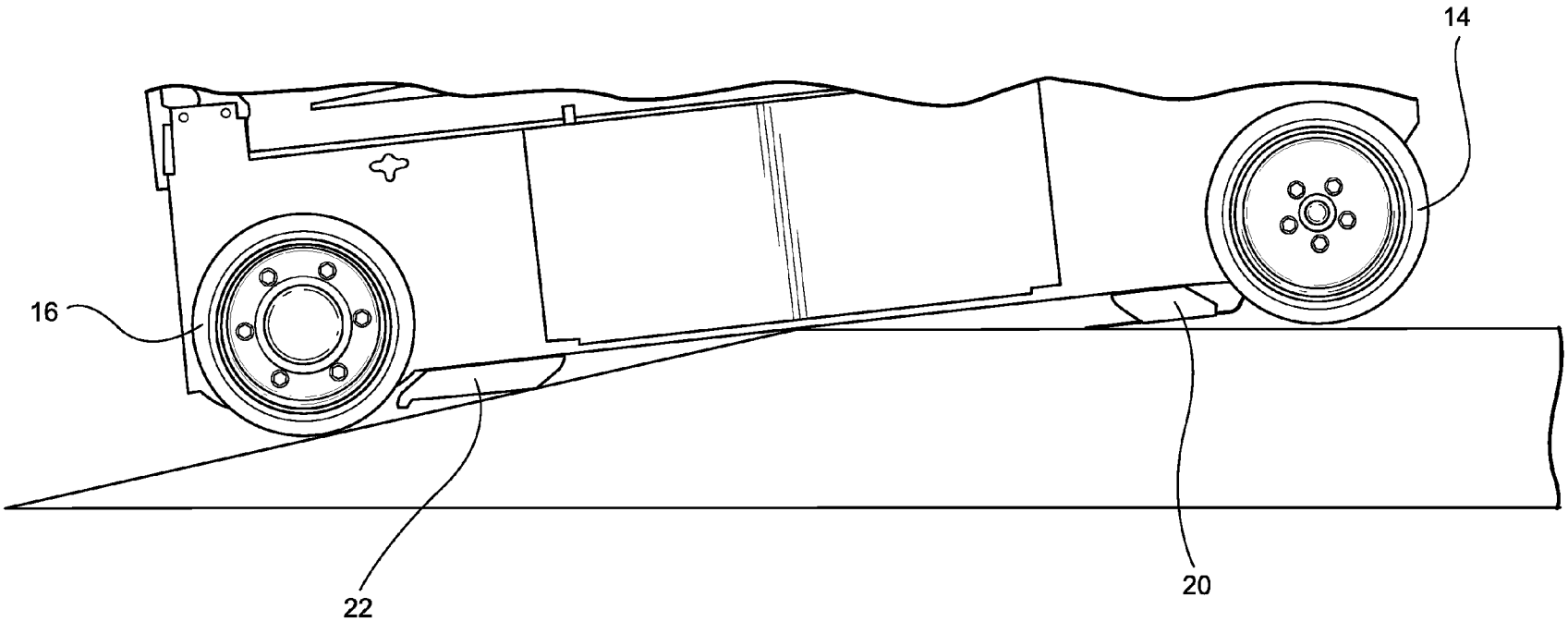
FIG. 5 shows the scissor lift with the fixed pothole protection assembly going over a grade.
Figure 6:
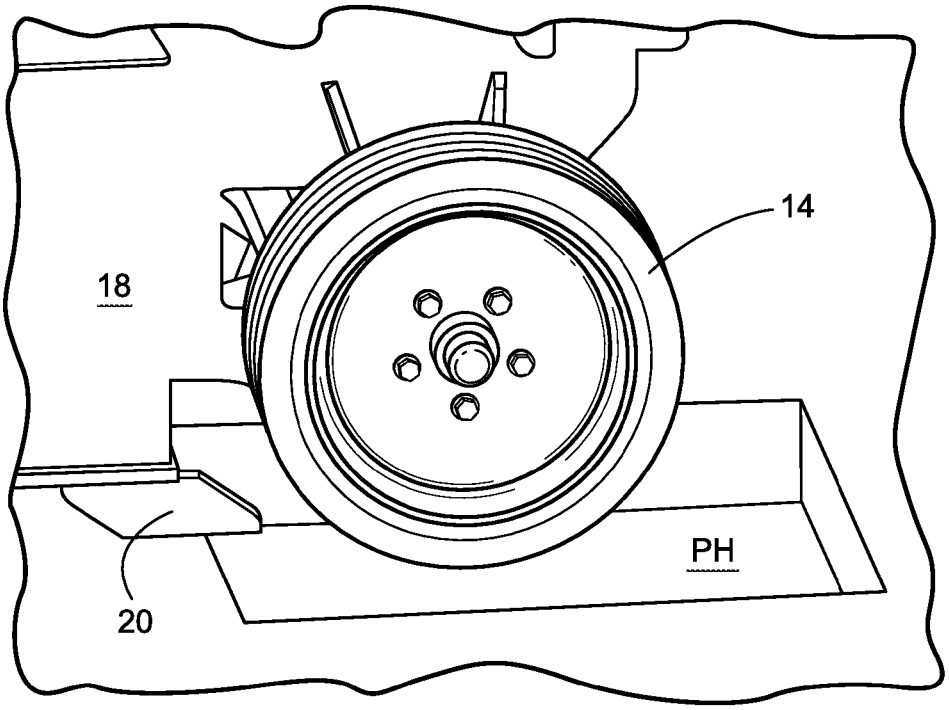
FIG. 6 shows the fixed pothole protection assembly with a wheel going into a pothole.

The front and rear pothole bars 20, 22 are generally formed of steel and are welded to the chassis 18. The frame plates 21, 23 are preferably integrated with the chassis 18. A size of the pothole bars 20, 22 is selected such that if an adjacent wheel falls into a pothole, the respective pothole bar adjacent that wheel will prevent the support base 10 from tilting beyond a predefined amount. Additionally, the frame plates 21, 23 inside the wheels are sized to catch edges of potholes while maximizing ground clearance because a profile of the frame plates 21, 23 enables them to follow the wheels up and over obstacles. That is, from a side view, the frame plates 21, 23 do not extend beyond a periphery of the wheels. FIG. 4 shows a front wheel 14 driving over a pothole PH with the front pothole protection bar 20 maintaining the stability of the support base 10 and scissor lift.

The fixed pothole protection assembly of the preferred embodiments achieves what existing active systems can in both stability and breakover angle without moving parts or sensors. The strategically placed pothole bars catch the edges of the pothole and keep the machine stable with the platform elevated. By keeping the components near the wheels, instead of all the way across the machine belly, acceptable ground clearance can be achieved.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A scissor lift comprising:

a support base including front wheels, rear wheels, and a chassis; and a pothole protection assembly, the pothole protection assembly including:

a pair of front pothole bars immovably fixed to the chassis and each positioned adjacent the front wheels, respectively;

a pair of rear pothole bars immovably fixed to the chassis and each positioned adjacent the rear wheels, respectively;

a front inner frame plate integrated with the chassis adjacent an inside surface of each of the front wheels and extending vertically directly below a center of each of the front wheels as viewed along a rotating axis of the front wheels; and a rear inner frame plate integrated with the chassis adjacent an inside surface of each of the rear wheels and extending vertically directly below a center of each of the rear wheels as viewed along a rotating axis of the rear wheels, wherein a space between the front wheels and the rear wheels defines a ground clearance zone, wherein the front pothole bars and the rear pothole bars are disposed at opposing ends of the ground clearance zone, and wherein the front and rear inner frame plates each comprises planar surfaces and end surfaces, the planar surfaces of the front inner frame plates being parallel with planes defined by the front wheels in a straight driving orientation, and the planar surfaces of the rear inner frame plates being parallel with planes defined by the rear wheels in a straight driving orientation, and wherein the front and rear inner frame plates do not form part of respective wheel axles on which the front and rear wheels are rotatably mounted.

2. A scissor lift according to claim 1, wherein the front pothole bars are positioned relative to the front wheels in a manner such that a vertical line tangent to the front wheels intersects a portion of the front pothole bars, and wherein the rear pothole bars are positioned relative to the rear wheels in a manner such that a vertical line tangent to the rear wheels intersects a portion of the rear pothole bars.

3. A scissor lift according to claim 2, wherein ends of the front and rear pothole bars are tapered.

4. A scissor lift according to claim 3, wherein the front and rear pothole bars are parallelogram shaped.

5. A scissor lift according to claim 4, wherein a bottom surface of the front pothole bars is skewed forward of a top surface of the front pothole bars, and wherein a bottom surface of the rear pothole bars is skewed rearward of a top surface of the rear pothole bars.

6. A scissor lift according to claim 1, further comprising a tilt sensor cooperable with the support base, the tilt sensor detecting a tilt amount of the scissor lift.

7. A scissor lift according to claim 6, further comprising a drive system that effects wheel drive and platform lift, wherein the tilt sensor communicates with the drive system such that if the tilt sensor detects that the tilt amount of the scissor lift exceeds a predefined amount, the drive system deactivates the wheel drive and the platform lift.

8. A pothole protection assembly in combination with a support base of a lift, the support base comprising front wheels, rear wheels, and a chassis, the pothole protection assembly comprising:

a front assembly including a pair of front pothole bars immovably fixed to the chassis and each positioned adjacent the front wheels, respectively, and sized such that when one of the front wheels falls into a pothole and the front pothole bar engages an area outside of the pothole, the front pothole bar adjacent the one of the front wheels will prevent the support base from tilting beyond a predefined amount; and a rear assembly including a pair of rear pothole bars immovably fixed to the chassis and each positioned adjacent the rear wheels, respectively, and sized such that when one of the rear wheels falls into a pothole and the rear pothole bar engages an area outside of the pothole, the rear pothole bar adjacent the one of the rear wheels will prevent the support base from tilting beyond a predefined amount, wherein the front assembly further includes a front inner frame plate adjacent an inside surface of each of the front wheels and integrated with the chassis, wherein the rear assembly further includes a rear inner frame plate adjacent an inside surface of each of the rear wheels and integrated with the chassis, wherein the front and rear inner frame plates each comprises planar surfaces and end surfaces, the planar surfaces of the front inner frame plates being parallel with planes defined by the front wheels in a straight driving orientation and positioned vertically directly below a center of the front wheels along a rotating axis of the front wheels, and the planar surfaces of the rear inner frame plates being parallel with planes defined by the rear wheels in a straight driving orientation and positioned vertically directly below a center of the rear wheels along a rotating axis of the rear wheels, and wherein the front and rear inner frame plates do not form part of respective wheel axles on which the front and rear wheels are rotatably mounted.

* * * * *